US012178342B2

(12) United States Patent
Kuzminski

(10) Patent No.: US 12,178,342 B2
(45) Date of Patent: Dec. 31, 2024

(54) BEVERAGE COVER

(71) Applicant: Fawn L. Kuzminski, Warren, PA (US)

(72) Inventor: Fawn L. Kuzminski, Warren, PA (US)

( * ) Notice: Subject to any disclaimer, the term of this patent is extended or adjusted under 35 U.S.C. 154(b) by 0 days.

(21) Appl. No.: 18/351,158

(22) Filed: Jul. 12, 2023

(65) Prior Publication Data

US 2023/0355016 A1 Nov. 9, 2023

Related U.S. Application Data

(63) Continuation of application No. 17/122,246, filed on Dec. 15, 2020, now Pat. No. 11,737,593.

(51) Int. Cl.

| | |
|---|---|
| ***A47G 23/02*** | (2006.01) |
| ***B65D 81/38*** | (2006.01) |
| ***F25D 31/00*** | (2006.01) |

(52) U.S. Cl.

CPC ..... *A47G 23/0266* (2013.01); *B65D 81/3876* (2013.01); *F25D 31/007* (2013.01); *A47G 2023/0275* (2013.01)

(58) Field of Classification Search

CPC ..... A47G 23/0266; A47G 2023/0275; B65D 81/3876; B65D 81/3886; F25D 31/007; F25D 2303/0843; F25D 2331/805; F25D 3/08

See application file for complete search history.

(56) References Cited

U.S. PATENT DOCUMENTS

| | | | | |
|---|---|---|---|---|
| 5,564,568 | A * | 10/1996 | Rankin, Sr. | F25D 3/08 206/446 |
| 6,349,846 | B1 | 2/2002 | Meza | |
| 2002/0104845 | A1 * | 1/2002 | Beuke | B65D 81/3876 220/739 |
| 2008/0128421 | A1 | 6/2008 | Ulbrand | |
| 2014/0061208 | A1 * | 3/2014 | Boyd | A47J 41/0005 220/592.17 |
| 2014/0284301 | A1 | 9/2014 | Coe | |
| 2015/0008232 | A1 | 1/2015 | Fidanza | |
| 2016/0213181 | A1 | 7/2016 | Gonzalez, II | |
| 2019/0308795 | A1 * | 10/2019 | Juneau | B65D 25/34 |
| 2020/0140182 | A1 * | 5/2020 | Adjeleian | A47G 23/02 |

* cited by examiner

*Primary Examiner* — Elizabeth J Martin
*Assistant Examiner* — Dario Antonio Deleon
(74) *Attorney, Agent, or Firm* — Jonathan M. D'Silva; MMI Intellectual Property

(57) ABSTRACT

A top insulator for a beverage container wherein the top insulator is configured to engage the beverage container. The top insulator being comprised of a thermally insulating material wherein said top insulator is configured to retain the beverage container at a selected temperature. A first surface, a second surface, and outer edge extends therebetween. The second surface has a well extending toward the second surface wherein the well is configured to accommodate a top end of the beverage container. The outer edge has a tab extending away therefrom.

1 Claim, 9 Drawing Sheets

BEVERAGE COVER

BACKGROUND OF THE INVENTION

(1) Field of the Invention

The disclosure relates to beverage sleeve devices and more particularly pertains to a new beverage sleeve device for thermally insulating a beverage container.

(2) Description of Related Art Including Information Disclosed Under 37 CFR 1.97 and 1.98

The prior art relates to beverage sleeve devices including a variety of beverage sleeves which including a cover that is positionable in a closed position for enclosing a beverage container positioned in the beverage sleeve. In at least one instance a refrigeratable cooling sleeve is included that can be inserted into the beverage sleeve for cooling the beverage container.

BRIEF SUMMARY OF THE INVENTION

An embodiment of the disclosure meets the needs presented above by generally comprising a cylinder that insertably receives a beverage container. A first flap is movably attached to the cylinder to close the cylinder. A second flap is movably attached to the cylinder to close the cylinder. A top insulator is releasably matable to the first flap to engage the beverage container. A bottom insulator is releasably matable to the second flap to engage the beverage container. Each of the top insulator and the bottom insulator are comprised of a thermally insulating material. A cooling sleeve is insertable into the cylinder to surround the beverage container. Moreover, the cooling sleeve is comprised of a refrigeratable material such that the cooling sleeve can be refrigerated thereby facilitating the cooling sleeve to cool the beverage container.

There has thus been outlined, rather broadly, the more important features of the disclosure in order that the detailed description thereof that follows may be better understood, and in order that the present contribution to the art may be better appreciated.

There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
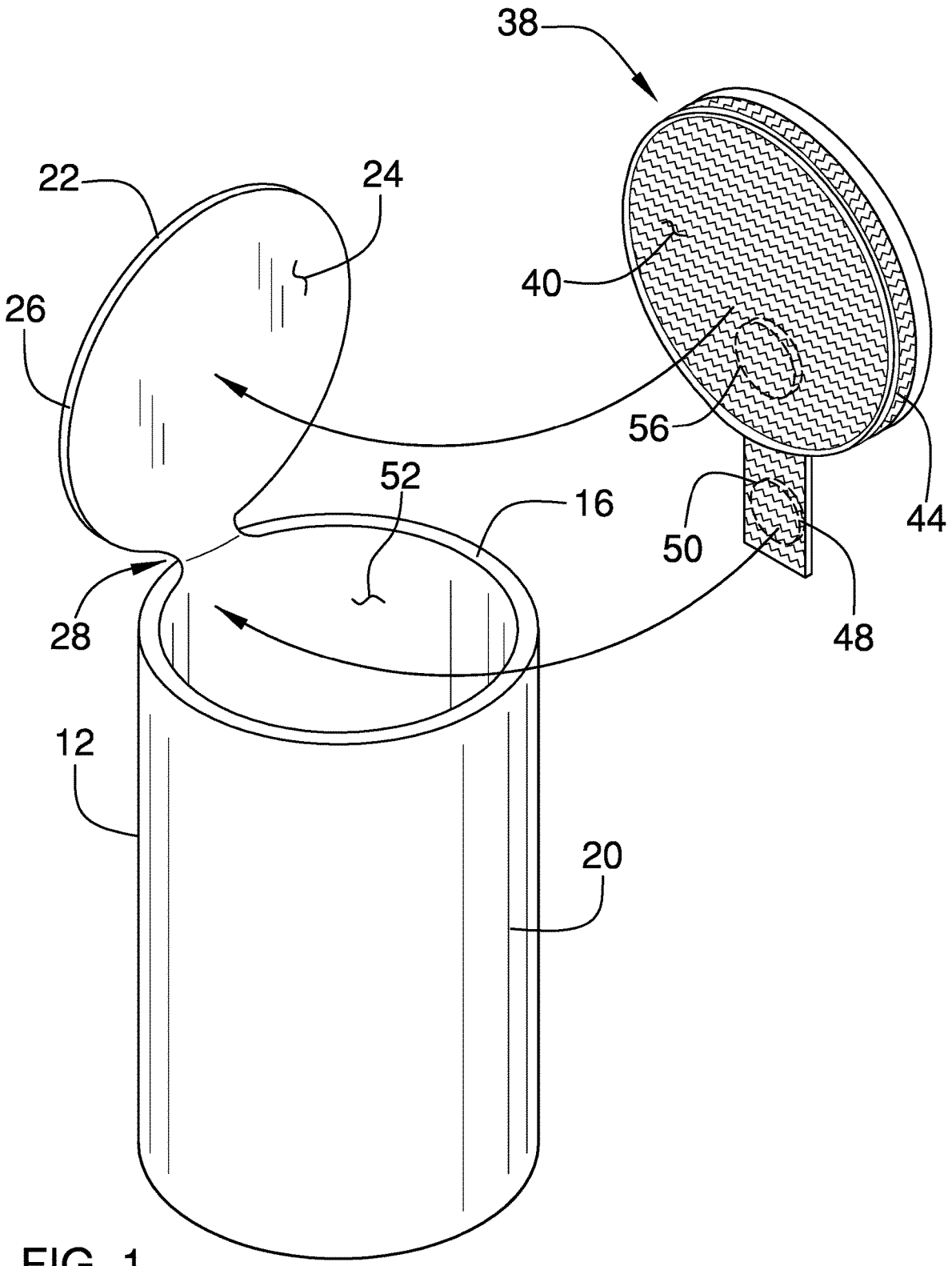
FIG. 1 is a perspective view of an insulated beverage sleeve assembly according to an embodiment of the disclosure showing a cylinder and a top insulator.
Figure 2:
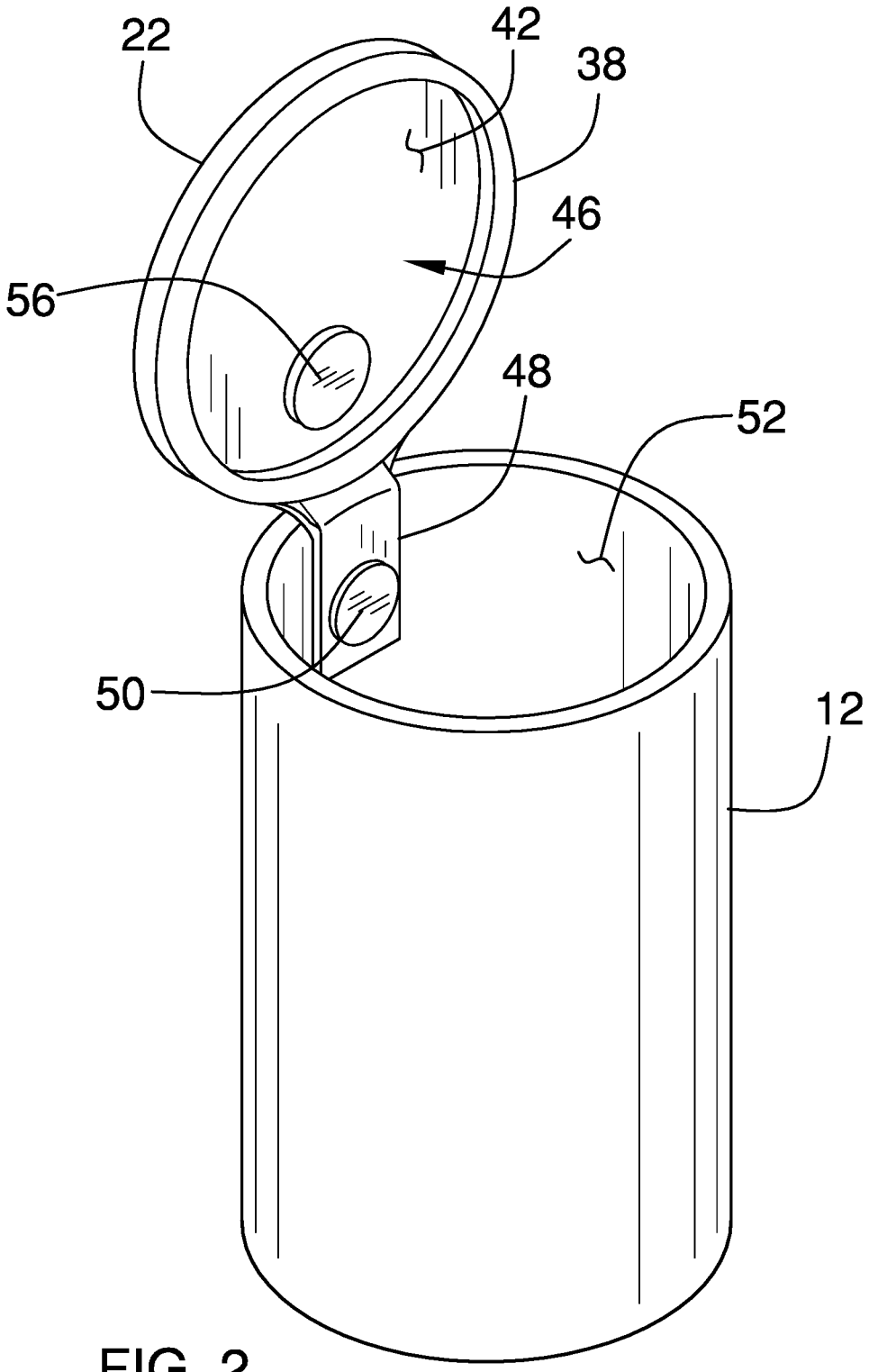
FIG. 2 is a perspective view of an embodiment of the disclosure showing a top insulator being attached to a first flap on a cylinder.
Figure 3:
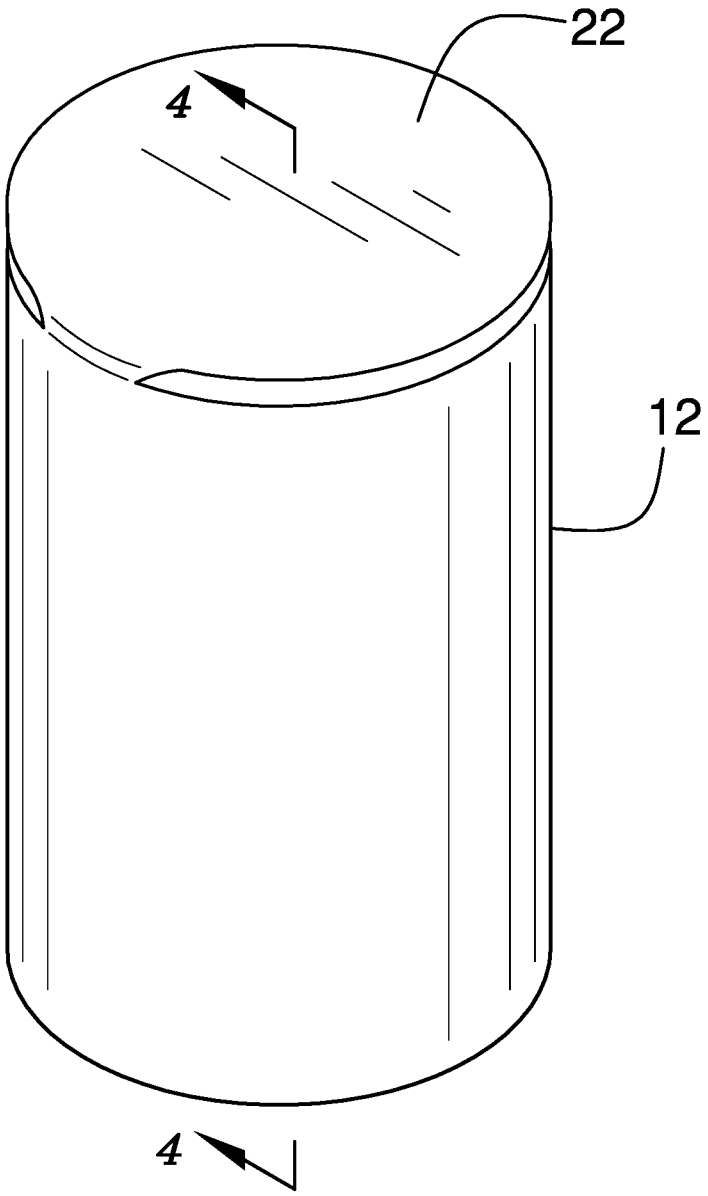
FIG. 3 is a back perspective view of an embodiment of the disclosure showing a first flap being closed on a cylinder.
Figure 4:
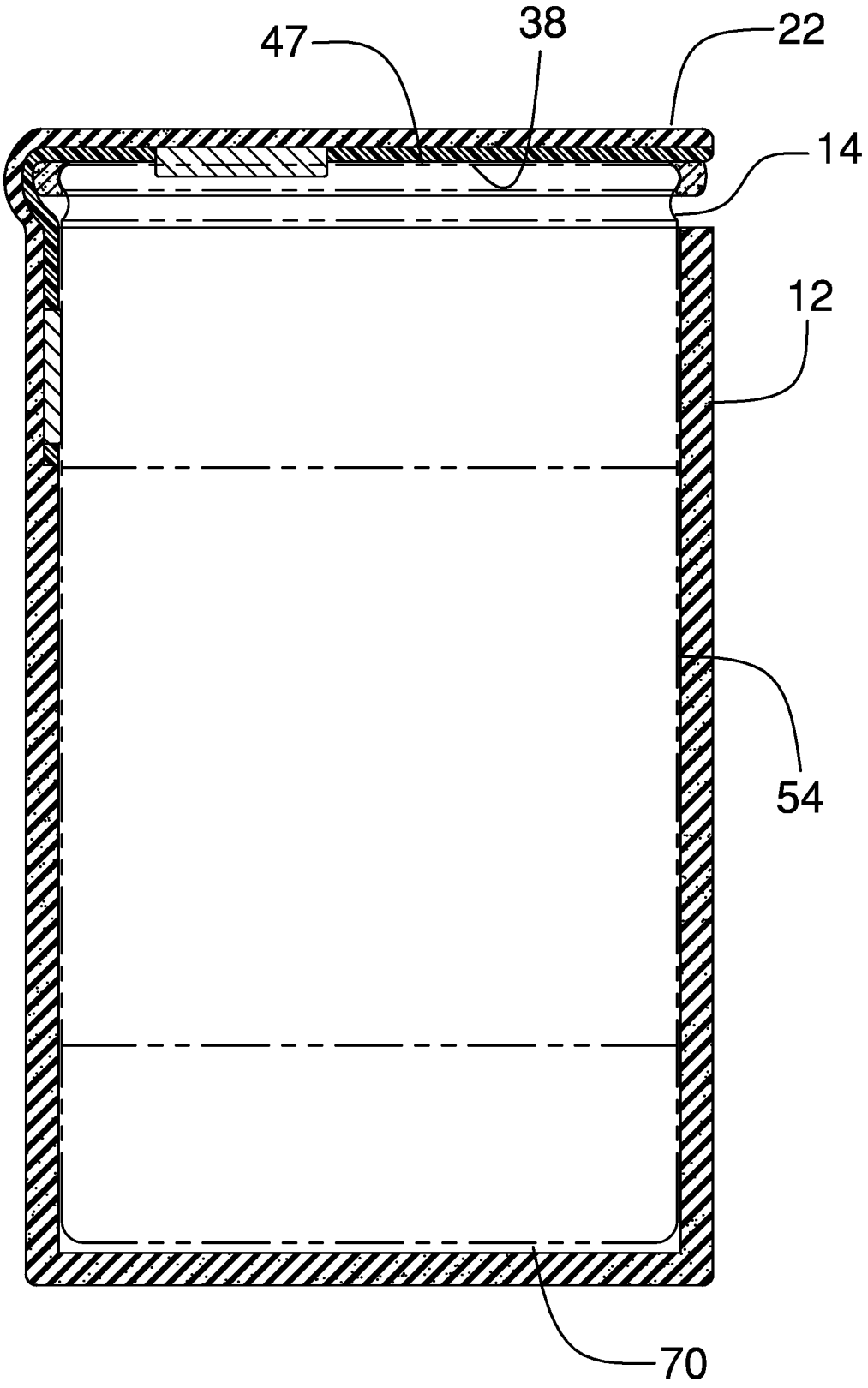
FIG. 4 is a cross sectional view taken along line 4-4 of FIG. 3 of an embodiment of the disclosure.
Figure 5:
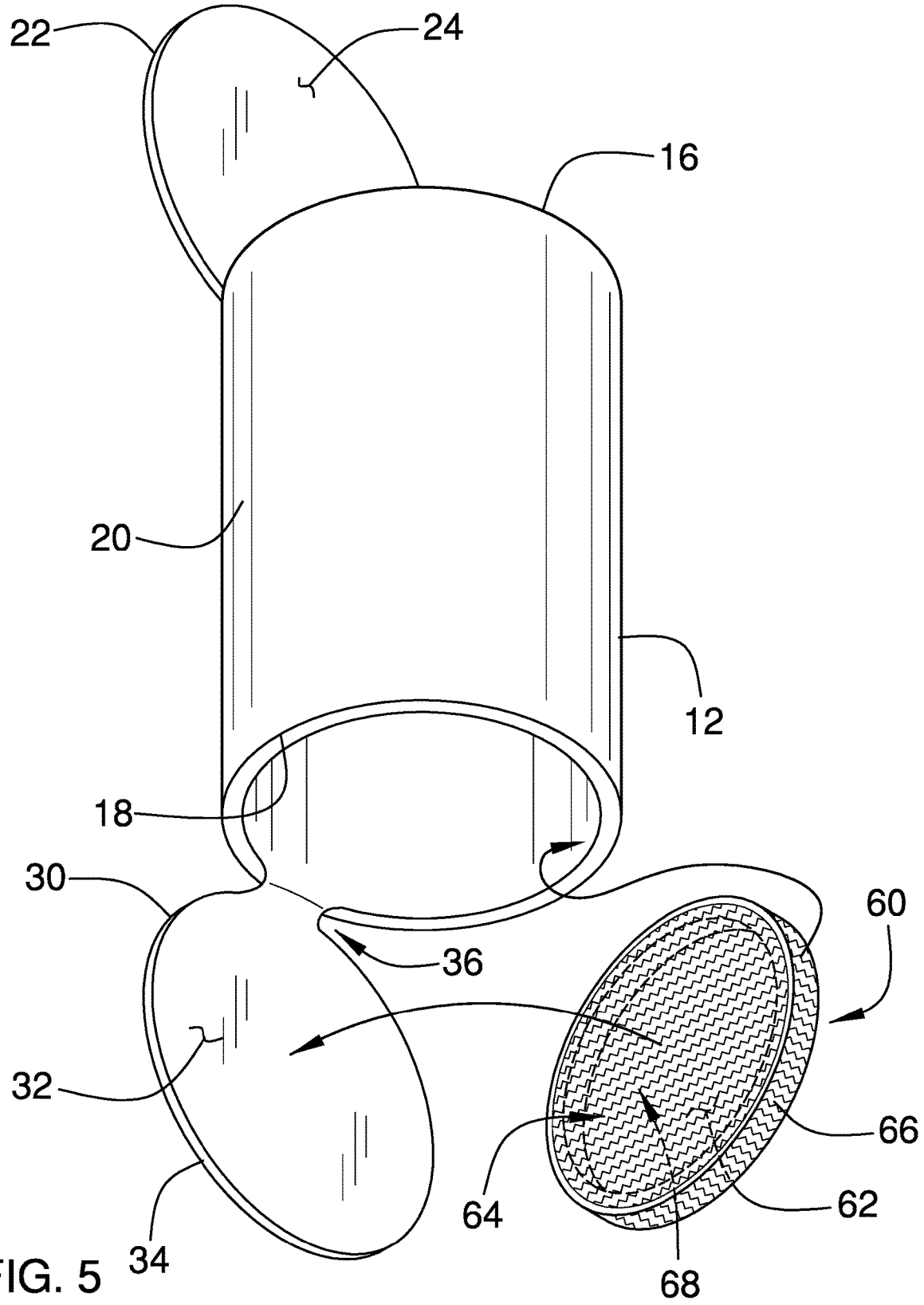
FIG. 5 is a bottom perspective view of an embodiment of the disclosure showing a cylinder and a bottom insulator.
Figure 6:
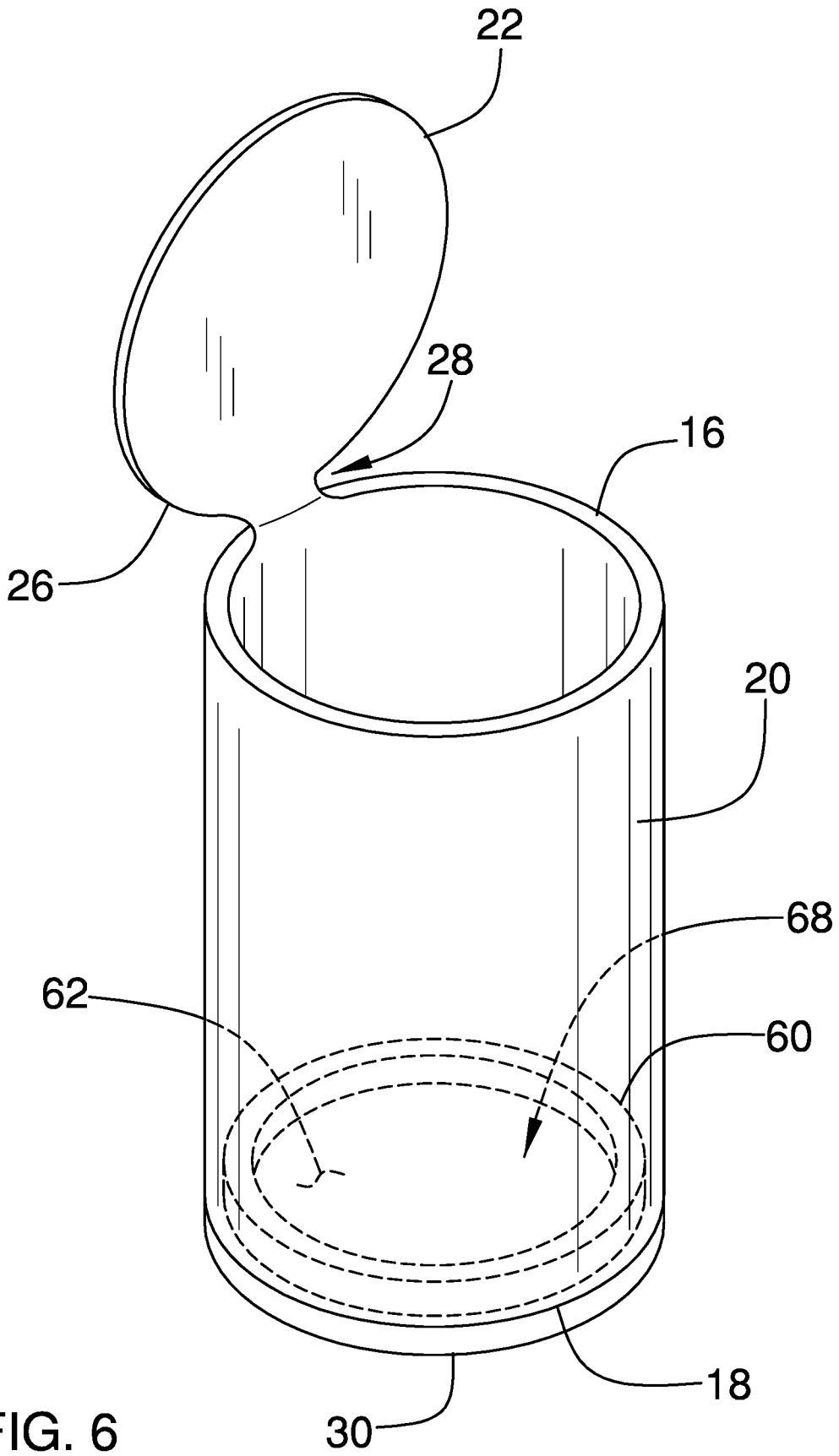
FIG. 6 is a phantom perspective view of an embodiment of the disclosure.
Figure 7:
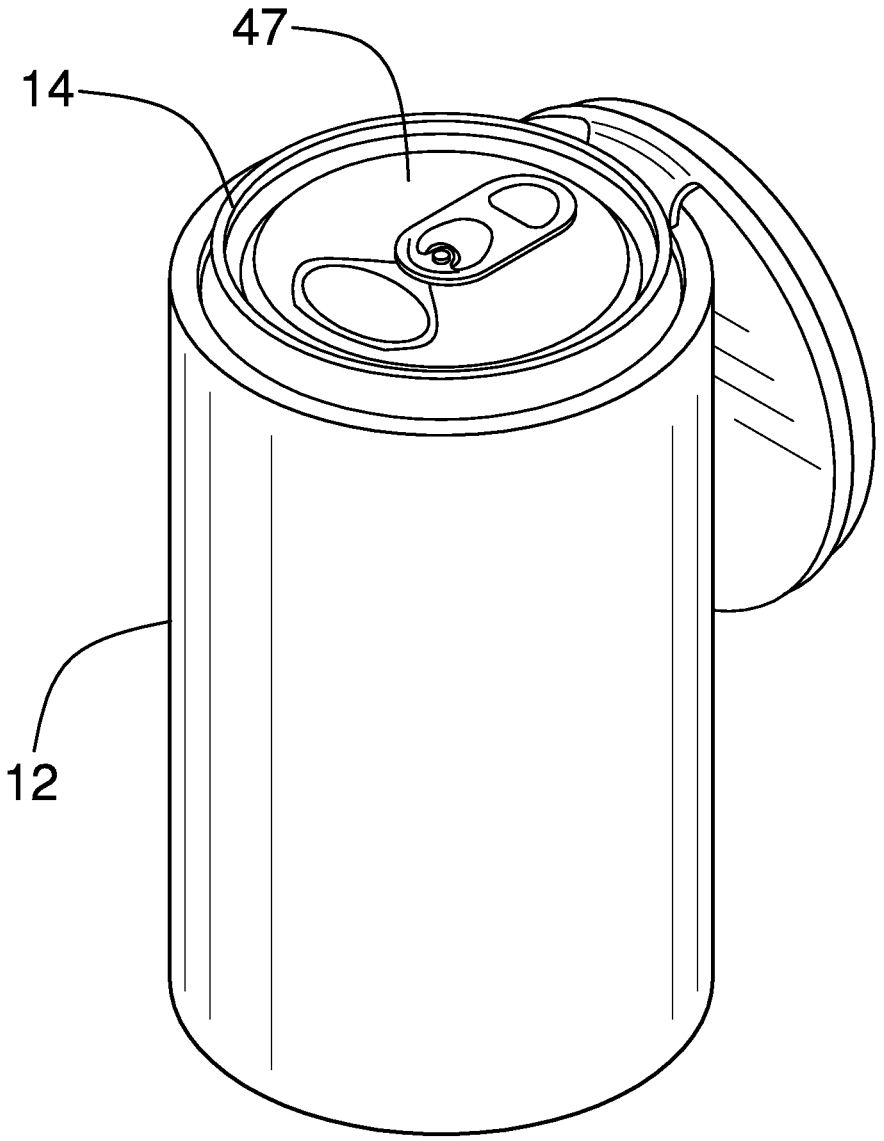
FIG. 7 is a perspective in-use view of an embodiment of the disclosure.
Figure 8:
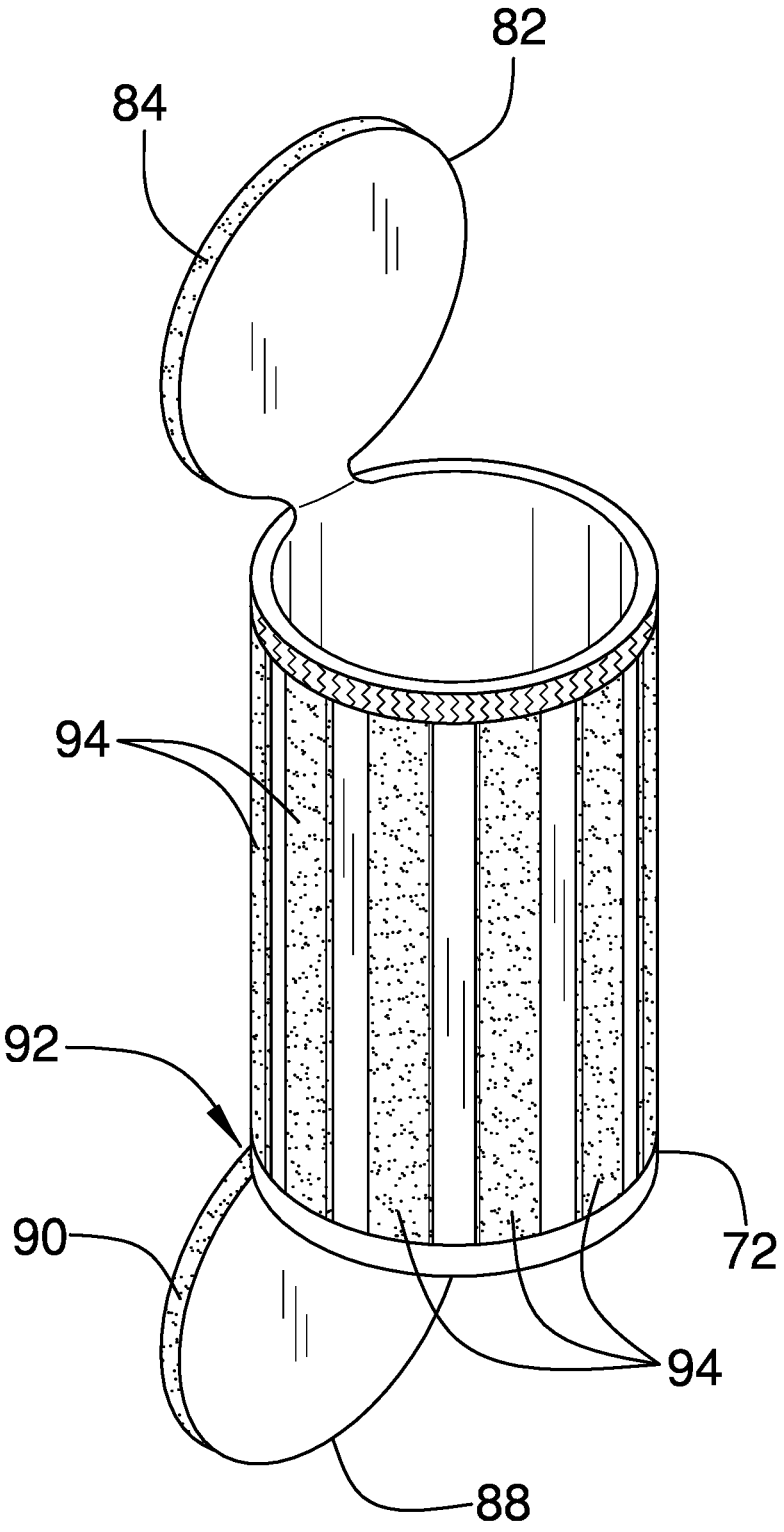
FIG. 8 is a perspective view of cooling sleeve of an embodiment of the disclosure.

With reference now to the drawings, and in particular to FIGS. 1 through 9 thereof, a new beverage sleeve device embodying the principles and concepts of an embodiment of the disclosure and generally designated by the reference numeral 10 will be described.

As best illustrated in FIGS. 1 through 9, the insulated beverage sleeve assembly 10 generally comprises a cylinder 12 that insertably receives a beverage container 14.

The beverage container 14 may be an aluminum can or other cylindrical beverage container. The cylinder 12 is comprised of a thermally insulating material to inhibit thermal communication between the beverage container 14 and ambient air. The cylinder 12 has a top end 16, a bottom end 18 and an outer wall 20 extending therebetween, and each of the top end 16 and the bottom end 18 is open.

A first flap 22 is movably attached to the cylinder 12 and the first flap 22 is closeable to close the cylinder 12. The first flap 22 has a bottom surface 24 and a perimeter edge 26, and the perimeter edge 26 is attached to the top end 16 of the cylinder 12 at an attachment point 28 located on the perimeter edge 26. Additionally, the bottom surface 24 rests on the top end 16 of the cylinder 12 when the first flap 22 is closed. A second flap 30 is movably attached to the cylinder 12 and the second flap 30 is closeable to close the cylinder 12. The second flap 30 has a top surface 32 and a perimeter edge 34, and the perimeter edge 34 of the second flap 30 is attached to the bottom end 18 of the cylinder 12 at an attachment point 36 located on the perimeter edge 26 of the second flap 30. The top surface 32 rests on the bottom end 18 of the cylinder 12 when the second flap 30 is closed.

A top insulator 38 is provided and the top insulator 38 is releasably matable to the first flap 22 to engage the beverage container 14. The top insulator 38 has a first surface 40, a second surface 42 and outer edge 44 extending therebetween. Each of the first surface 40 and the outer edge 44 comprises a fabric engaging material. In this way the first surface 40 is releasably matable to the bottom surface 24 of the first flap 22 and the outer edge 44 is releasably matable to an inside surface of the outer wall 20 of the cylinder 12 when the first flap 22 is closed. The cylinder 12 may be comprised of neoprene and the fabric engaging material may comprise a hook portion of a hook and loop fastener.

The second surface 42 has a well 46 extending toward the outer edge 44 to accommodate a top 47 of the beverage container 14. The outer edge 44 has a tab 48 extending away therefrom and the tab 48 is comprised of a fabric engaging material. In this way the tab 48 is releasably mateable to the inside surface of the outer wall 20 of the cylinder 12. Moreover, the top insulator 38 is comprised of a thermally insulating material to retain the beverage container 14 at a selected temperature. The tab 48 may be comprised a hook portion of a hook and loop fastener.

A first magnet 50 is coupled to the tab 48 such that the first magnet 50 is exposed when the tab 48 is mated to an inside surface 52 of the outer wall 20 of the cylinder 12. Additionally, the first magnet 50 may engage a ferromagnetic surface, such as a refrigerator door, for storing the top insulator 38. A second magnet 56 is coupled to the second surface 42 of the insulator such that the second magnet 56 is positioned in the well. In this way the second magnet 56 can magnetically engage the first magnet 50 when the first flap 22 is opened and laid down on the outer wall 20 of the cylinder 12. Thus, the first flap 22 can be secured when the first flap 22 is not closed over the cylinder 12. Additionally, the second magnet 56 may engage a ferromagnetic surface, such as the refrigerator door, for storing the top insulator 38.

A bottom insulator 60 is releasably matable to the second flap 30 to engage the beverage container 14. The bottom insulator 60 has an upper surface 62, a lower surface 64 and an outer edge 66 extending therebetween. Moreover, each of the lower surface 64 and the outer edge 66 of the bottom insulator 60 is comprised of a fabric engaging material. In this way the lower surface 64 is releasably mated to the top surface 32 of the second flap 30 and the outer edge 66 of the bottom insulator 60 is releasably mated to the inside surface 52 of the outer wall 20 of the cylinder 12. The upper surface 62 has a well 68 extending toward the lower surface 64 to receive a bottom 70 of the beverage container 14. Additionally, the bottom insulator 60 is comprised of a thermally insulating material to retain the beverage container 14 at a preferred temperature.

A cooling sleeve 72 is insertable into the cylinder 12 such that the cooling sleeve 72 surrounds the beverage container 14. The cooling sleeve 72 is comprised of a refrigeratable material such that the cooling sleeve 72 can be refrigerated. In this way the cooling sleeve 72 can cool the beverage container 14 when the beverage container 14 is inserted into the cooling sleeve 72 when the cooling sleeve 72 is inserted in the cylinder 12. The cooling sleeve 72 has an upper end 74 and a lower end 76, and a mating member 78 is coupled to and extends around an outer surface 80 of the cooling sleeve 72.

Moreover, the mating member 78 is aligned with the upper end 74. The mating member 78 releasably engages the inside surface 52 of the outer wall 20 of the cylinder 12 when the cooling sleeve 72 is inserted into the cylinder 12 for releasably engaging the cylinder 12.

A first cooling flap 82 is provided and the first cooling flap 82 is movably attached to the cooling sleeve 72. The first cooling flap 82 has an outer edge 84 that is coupled to the upper end 74 of the cooling sleeve 72 at an attachment point 86 located on the outer edge 44 of the first cooling flap 82 for closing the upper end 74. A second cooling flap 88 is provided and the second cooling flap 88 is movably attached to the cooling sleeve 72. The second cooling flap 88 has an outer edge 90 that is coupled to the lower end 76 of the cooling sleeve 72 at an attachment point 92 located on the outer edge 44 of the second cooling flap 88 for closing the lower end 76. Each of the first cooling flap 82 and the second cooling flap 88 may be comprised of neoprene thereby facilitating the top insulator 38 and the bottom insulator 60 to be attached to the respective first cooling flap 82 and second cooling flap 88.

Figure 9:
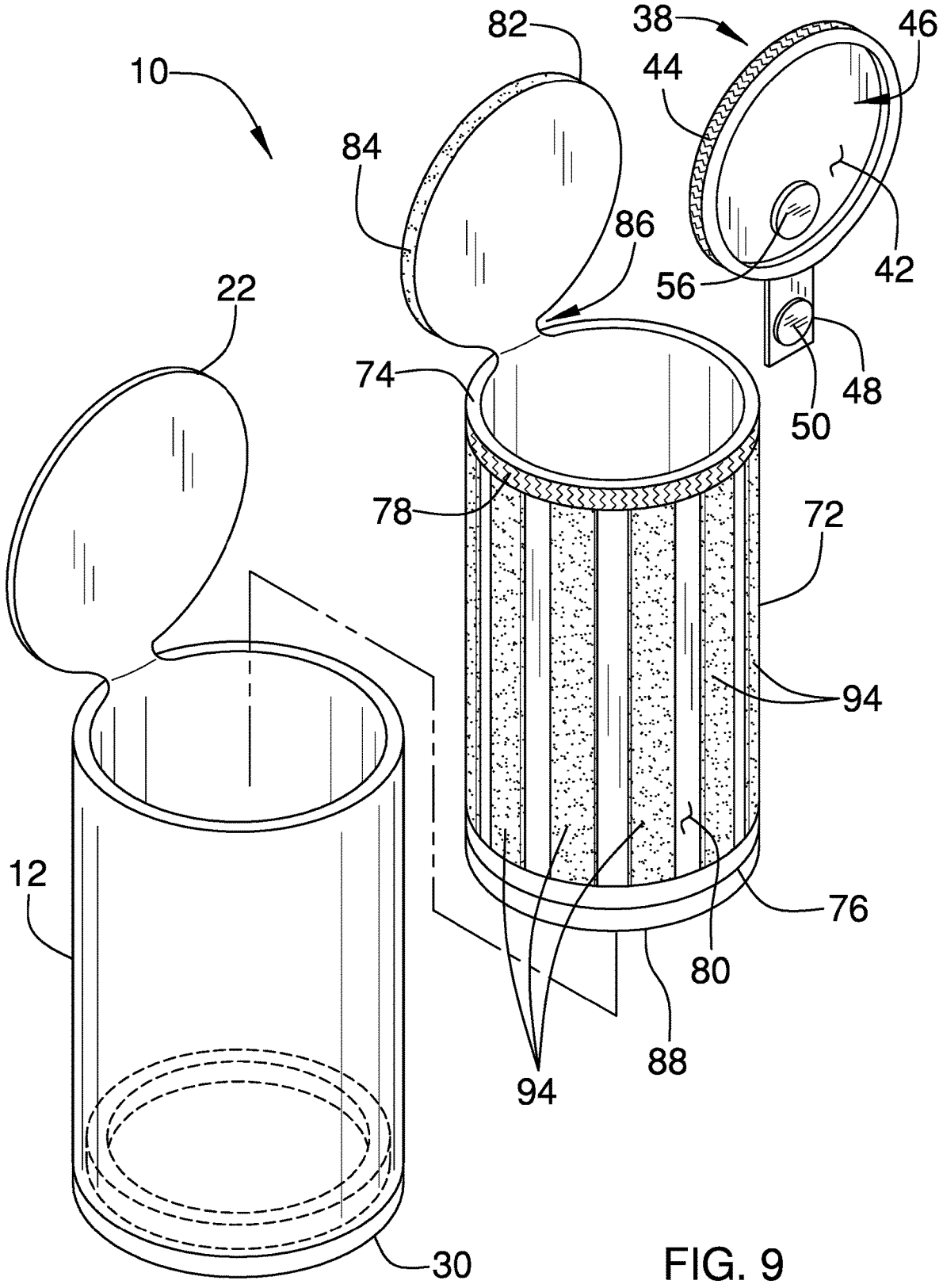
FIG. 9 is an explode perspective view of an embodiment of the disclosure.

As is most clearly shown in FIG. 9, the cooling sleeve 72 may include a plurality of cells 94 that each extend between the upper end 74 and the lower end 76 of cooling sleeve 72. Additionally, the cells 94 may be spaced apart from each other and may be distributed around a full circumference of the cooling sleeve 72. Each of the cells 94 may be comprised of a thermal gel material, such as diethylene glycol or ethylene glycol, that can be repeatedly refrigerated and that will remain at a cooled temperature for an extended period of time.

In use, the beverage container 14 can be inserted into the cylinder 12 and each of the first flap 22 and the second flap 30 can be closed to contain the beverage container 14 in the cylinder 12. Additionally, the top insulator 38 can be attached to the first flap 22 and the bottom insulator 60 can be attached to the second flap 30. In this way the top insulator 38 and the bottom insulator 60 not only thermally insulate the beverage container 14, but also releasably retain the first flap 22 and the second flap 30 in the closed position. Moreover, insects and debris are inhibited from entering the beverage container 14 when the beverage container 14 is positioned in the cylinder 12. The cooling sleeve 72 can be refrigerated and subsequently inserted into the cylinder 12 thereby facilitating the beverage container 14 to be inserted into the cooling sleeve 72. In this way the beverage container 14 can be cooled while the beverage container 14 is positioned in the cylinder 12.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A top insulator for a beverage container wherein the top insulator is configured to engage the beverage container comprising:

said top insulator being comprised of a thermally insulating material wherein said top insulator is configured to retain the beverage container at a selected temperature;

a first surface, a second surface, and outer edge extending therebetween;

said second surface has a well extending toward said outer edge wherein said well accommodates a top end of the beverage container, said outer edge having a tab extending away therefrom and said tab rests against the beverage container when in use;

a first magnet coupled to said tab, said first magnet;

a second magnet coupled to said second surface such that said second magnet engages said first magnet when said second surface is laid against said tab.

* * * * *